US009324517B2

(12) United States Patent
Chang

(10) Patent No.: US 9,324,517 B2
(45) Date of Patent: Apr. 26, 2016

(54) SWITCH ACTUATOR HAVING LIGHT GUIDING FEATURES

(71) Applicant: HON HAI PRECISION INDUSTRY CO., LTD., New Taipei (TW)

(72) Inventor: Shao-Han Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 29 days.

(21) Appl. No.: 14/496,669

(22) Filed: Sep. 25, 2014

(65) Prior Publication Data

US 2015/0144470 A1 May 28, 2015

(30) Foreign Application Priority Data

Nov. 22, 2013 (CN) ..... 2013 1 05914368

(51) Int. Cl.

| | |
|---|---|
| ***H01H 9/00*** | (2006.01) |
| ***H01H 23/02*** | (2006.01) |
| ***H01H 23/08*** | (2006.01) |
| ***H01H 23/14*** | (2006.01) |

(52) U.S. Cl.

CPC ..... *H01H 23/025* (2013.01); *H01H 23/08* (2013.01); *H01H 23/143* (2013.01); *H01H 2219/06* (2013.01); *H01H 2219/062* (2013.01); *H01H 2221/07* (2013.01)

(58) Field of Classification Search

CPC ... H01H 23/025; H01H 9/161; H01H 13/023; H01H 2013/026

USPC ..... 200/310, 131, 315, 317

See application file for complete search history.

(56) References Cited

U.S. PATENT DOCUMENTS

| | | | | |
|---|---|---|---|---|
| 5,752,595 A * | 5/1998 | Fein | ..... | H01H 23/06 200/302.3 |
| 6,013,885 A * | 1/2000 | Kowalczyk | ..... | H01H 23/025 200/302.3 |
| 7,105,762 B1 * | 9/2006 | Lee | ..... | H01H 23/025 200/339 |
| 7,884,297 B2 * | 2/2011 | Okuzumi | ..... | H01H 23/143 200/315 |

FOREIGN PATENT DOCUMENTS

| | | |
|---|---|---|
| CN | 101923971 A | 12/2010 |
| TW | 162906 | 7/1991 |
| TW | 201009869 A1 | 3/2010 |
| TW | 201135783 A1 | 10/2011 |

* cited by examiner

*Primary Examiner* — Vanessa Girardi

(74) *Attorney, Agent, or Firm* — Novak Druce Connolly Bove + Quigg LLP

(57) ABSTRACT

A switch assembly includes a base plate and a switch element. The base plate includes a protrusion, a first light emitting diode, a second light emitting diode, a first switch contact, and a second switch contact. The first light emitting diode and the first switch contact are positioned on a first side of the protrusion, and the second light emitting diode and the second switch contact are positioned on a second side of the protrusion. The switch element is movably mounted on the protrusion and contactable with the first switch contact and the second switch contact. The switch element includes a light guiding portion with a first light incident surface positioned above the first light emitting diode, a second light incident surface positioned above the second light emitting diode, and a light emitting surface.

12 Claims, 6 Drawing Sheets

SWITCH ACTUATOR HAVING LIGHT GUIDING FEATURES

FIELD

The subject matter herein generally relates to interfaces of portable electronic devices.

BACKGROUND

Many portable electronic devices have a housing with an inner compartment for receiving a printed circuit board. For convenience, a portable electronic device usually includes a switch assembly placed in a sidewall of the housing. The functions of receiving calls, activating background light, adjusting volume, or browsing menu are easily achieved by a single touch of user with a switch assembly.

A typical portable electronic device includes a housing and a circuit board mounted in the housing. Two receiving holes are defined in a sidewall of the housing. A typical switch assembly includes two buttons and two switches. Each button has an operating portion and a contact portion. Each operating portion is received in one of the receiving holes and one end thereof protrudes from the receiving hole of the sidewall of the housing. Thus, the operating portion is externally accessible to a user. Each switch or a portion thereof is located on the circuit board. Each contact portion is positioned adjacent to a switch. When the user presses the operating portion, the contact portion actuates the switch to activate a function.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
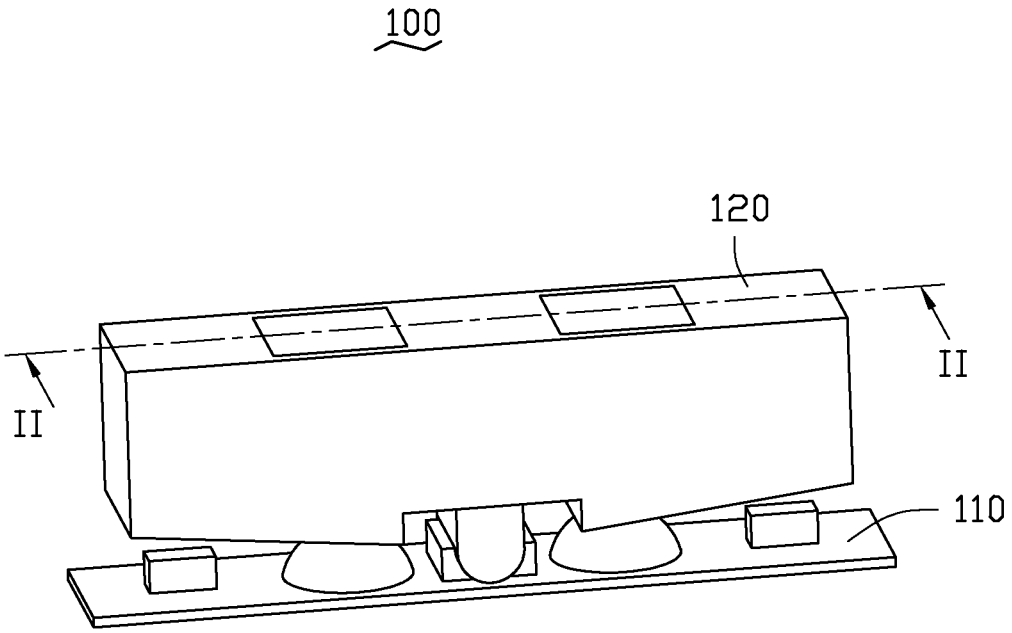
FIG. 1 is an isometric view of an embodiment of a switch assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape, or other feature that is modified by the word "substantially", such that the feature of the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The switch assembly of this disclosure can include a base plate and a switch element. The base plate can include a protrusion, two light emitting diodes (LEDs), and two switch contacts. The switch element can be movably mounted on the base plate, whereby the functions of the two switch contacts are exclusive. When one switch contact is pressed, the corresponding LED can emit light to remind users that the switch contact is switched on. The visual indicators of the switch assembly can prevent users pressing the switch element too many or too few times.

FIG. 1 illustrates a switch assembly 100 including a base plate 110 and a switch element 120 movably mounted on the base plate 110. The switch assembly 100 can be assembled in a sidewall of a housing of a portable electronic device (not shown).

Figure 2:
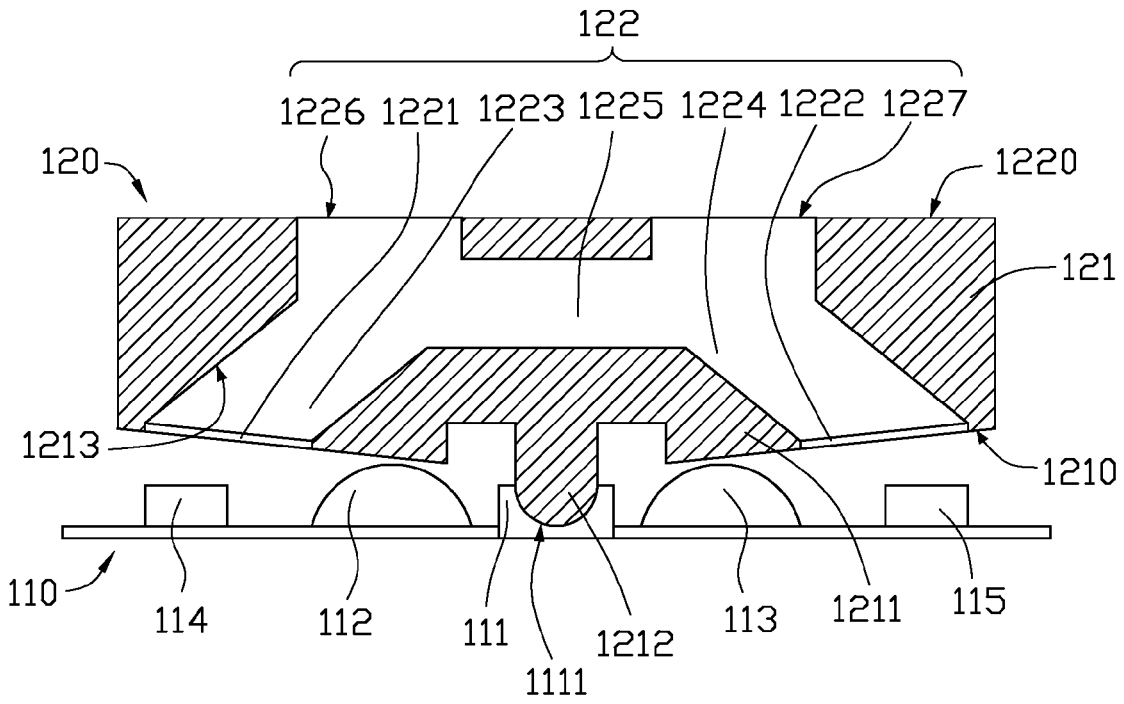
FIG. 2 is a cross-sectional view of the switch assembly of FIG. 1 taken along line II-II.

FIG. 2 illustrates the base plate 110 including a protrusion 111, a first switch contact 112, a second switch contact 113, a first LED 114 positioned on a first side of the protrusion 111, and a second LED 115 positioned on a second side of the protrusion 111 opposite the first side. The protrusion 111 can be positioned in a central portion of the base plate 110. The first switch contact 112 can be positioned on the first side of the protrusion 111 between the first LED 114 and the protrusion 111, and the second switch contact 113 can be positioned on the second side of the protrusion 111 between the second LED 115 and the protrusion 111.

The protrusion 111 can be substantially cubic, cylindrical, or other shape, and can include a recess 1111 in the central portion. The first switch contact 112 and the second switch contact 113 can be made of a metal reed which is flexible and elastic. When pressed, the first switch contact 112 or the second switch contact 113 is switched on and generates an electrical event. After that, the metal reed can return to the original position, and the first switch contact 112 or the second switch contact 113 become idle again.

The first LED 114 and the second LED 115 may be symmetrical around the protrusion 111. The first LED 114 and the second LED 115 can emit light of different colors. The first LED 114 can emit one color of light when the first switch contact 112 is switched on, and the second LED 115 can emit another color of light when the second switch contact 113 is switched on, to indicate that the first switch contact 112 or the second switch contact 113 (as the case may be) is switched on. In at least one embodiment, the colors of the first LED 114 and the second LED 115 can be selected from the group of blue, red, yellow, and white.

The switch element 120 can be movably mounted on the protrusion 111 and contactable with the first switch contact 112 and the second switch contact 113. The switch element 120 can have a first surface 1210 facing the base plate 110 and a second surface 1220 substantially opposite the first surface 1210 and facing away from the base plate 110. The switch element 120 can include a reflective portion 121 connected with the base plate 110, and a light guiding portion 122 surrounded by the reflective portion 121.

The reflective portion 121 can be substantially strip-shaped and include a supporting portion 1211. The supporting portion 1211 can be positioned at the bottom of the reflective portion 121 and near the base plate 110. The supporting portion 1211 can be substantially T-shaped and include a protrusion part 1212 in the center thereof. The two ends of the supporting portion 1211 can be inclined to the base plate 110, whereby the supporting portion 1211 can be spaced from the base plate 110 when the reflective portion 121 is not being pressed. When one end of the reflective portion 121 is pressed, one of either the first switch contact 112 or the second switch contact 113 can be pressed by the supporting portion 1211. The protrusion part 1212 can be movably assembled in the recess 111 of the protrusion 111. When one side of the switch element 120 is pressed downwardly, the protrusion part 1212 of the supporting portion 1211 can rotate in the recess 1111 of the protrusion 111, and the other end of the switch element 120 can move upwardly. Therefore, the functions of the first switch contact 112 and the second switch contact 113 are exclusive.

The reflective portion 121 can further include a number of reflective surfaces 1213 toward the light guiding portion 122. The reflective surfaces 1213 can be attached with a high reflectance coating or a high reflectance mirror. The reflectance of the reflective surfaces 1213 can be larger than 80%.

The light guiding portion 122 can be arranged in the inner part of the reflective portion 121. The light guiding portion 122 can include a first light incident surface 1221 forming a portion of the first surface 1210 and positioned substantially above the first LED 114, a second light incident surface 1222 forming another portion of the first surface 1210 and positioned substantially above the second LED 115, a first incident portion 1223, and a second incident portion 1224. The first incident portion 123 can extend obliquely from the first incident surface 1221 to the interior of the reflective portion 121, and the second incident portion 124 can extend obliquely from the second incident surface 1222 to the interior of the reflective portion 121. The first incident portion 1223 and the second incident portion 1224 can be positioned oblique to the base plate 110 and in symmetry. The light guiding portion 122 can further include an emitting portion 1225 at the ends of the first incident portion 1223 and the second incident portion 1224. The emitting portion 1225 can be separated by the reflective portion 121, and the light guiding portion 122 can further include a first light emitting surface 1226 and a second emitting surface 1227 forming a portion of the second surface 1220. The first light emitting surface 1226 and the second light emitting surface 1227 can be visible from outside the mobile electronic device. The first light emitting surface 1226 can be used to transmit the light emitted from the first LED 114, and the second light emitting surface 1227 can be used to transmit the light emitted from the second LED 115. The light incident surfaces 1221, 1222 and the light emitting surfaces 1226, 1227 can have lenses made of tough, high-strength, transparent materials.

Figure 3:
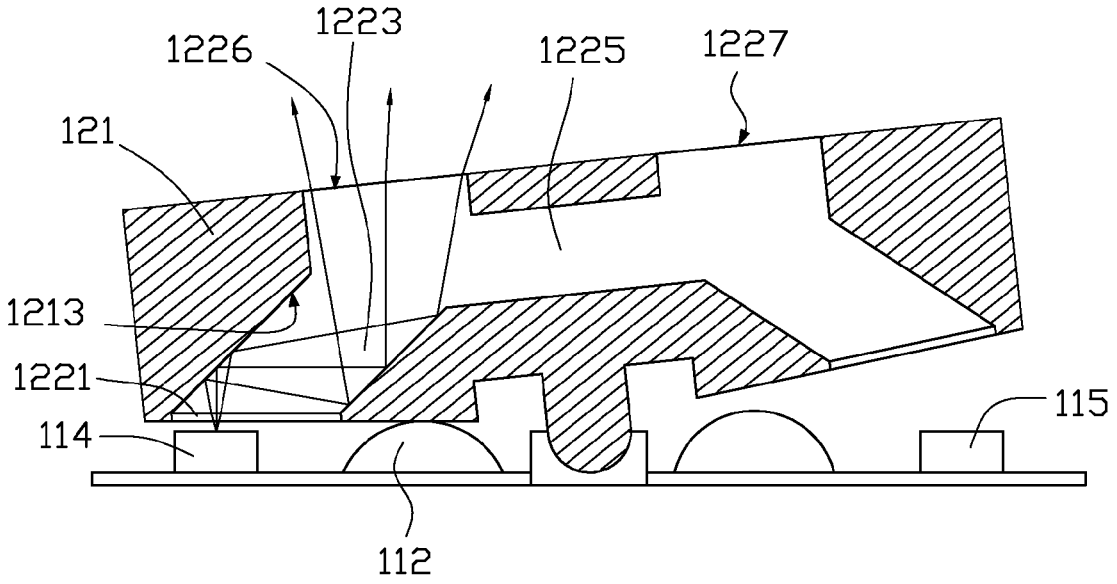
FIG. 3 is a cross-sectional view revealing light paths of the switch assembly of FIG. 2.

FIG. 3 reveals light paths of the switch assembly 100. When the first switch contact 112 is pressed, the first LED 114 emits light. The light emitted from the first LED 114 can be transmitted to the first incident portion 1221 through the first incident surface 1121, reflected by the reflective surface 1213, and then transmitted to the outside of the switch element 120 through the first light emitting surface 1226. Similarly, when the second switch contact 113 is pressed, the light emitted from the second LED 115 can be transmitted to the outside of the switch element 120 through the second light emitting surface 1227.

In other embodiments, when the mobile electronic device receives a new text message, or the mobile electronic device is powered on, the first LED 114 and the second LED 115 can light up at the same time, controlled by a circuit in the mobile electronic device. Furthermore, the first LED 114 and the second LED 115 can blink to warn or remind the user of a particular state.

Figure 4:
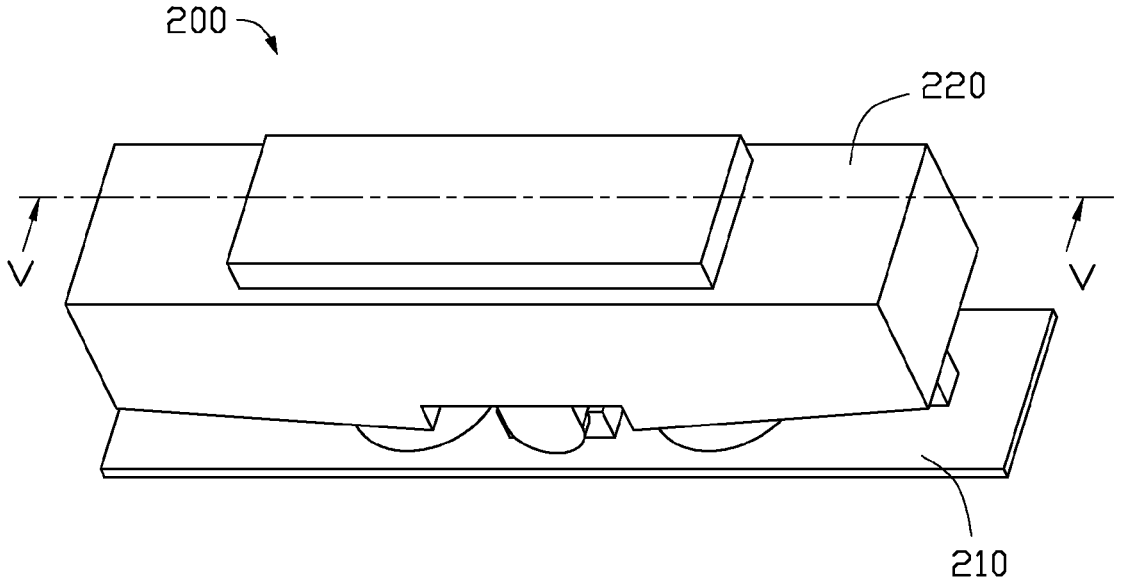
FIG. 4 is an isometric view of another embodiment of a switch assembly.

FIG. 4 illustrates a switch assembly 200 according to another embodiment. The switch assembly 200 can include a base plate 210 and a switch element 220.

Figure 5:
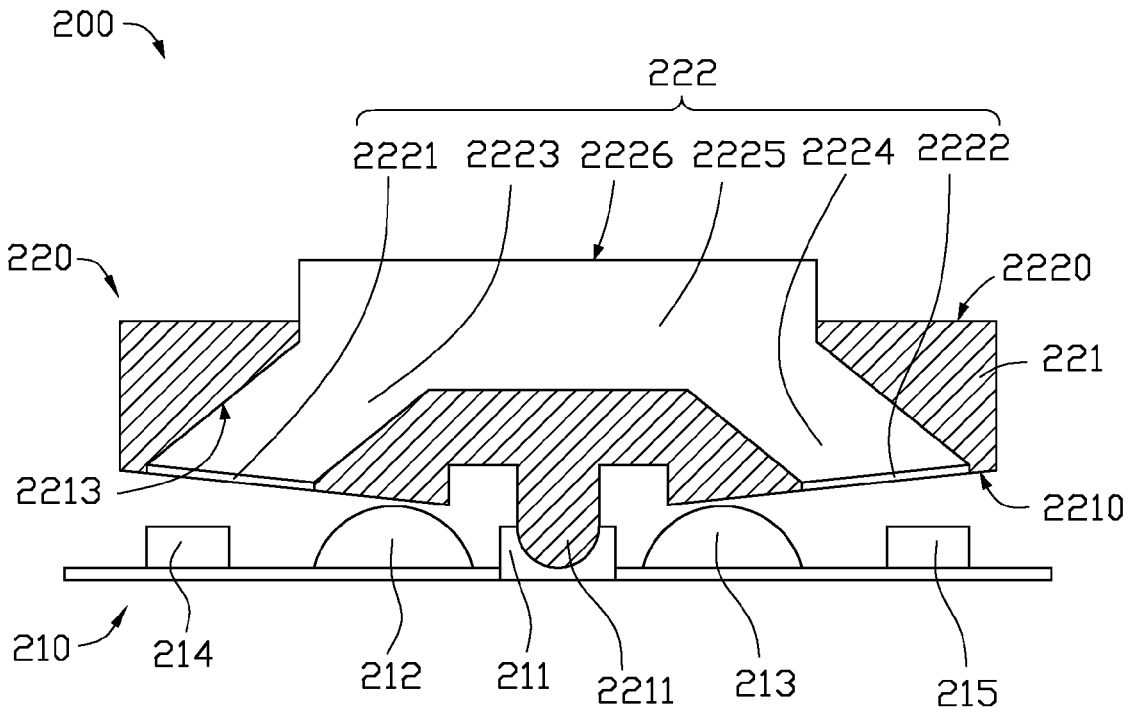
FIG. 5 is a cross-sectional view of the switch assembly of FIG. 4 taken along line V-V.

FIG. 5 illustrates that the base plate 210 can include a protrusion 211, a first switch contact 212, a second switch contact 213, a first LED 214 positioned on a first side of the protrusion 211, and a second LED 215 positioned on a second side of the protrusion 211 opposite the first side. The first switch contact 212 can be positioned on the first side of the protrusion 211 between the first LED 214 and the protrusion 211, and the second switch contact 213 can be positioned on the second side of the protrusion 211 between the second LED 215 and the protrusion 211.

The switch element 220 can be movably mounted on the protrusion 211 and contactable with the first switch contact 212 and the second switch contact 213. The switch element 220 can have a first surface 2210 facing the base plate 210 and a second surface 2220 substantially opposite the first surface 2210 and facing away from the base plate 210. The switch element 220 can include a reflective portion 221 and a light guiding portion 222 surrounded by the reflective portion 221. The reflective portion 221 can include a supporting portion 2211 and a plurality of reflective surfaces 2213 near the light guiding portion 222.

The switch assembly 200 can be substantially the same as the switch assembly 100 in the first embodiment, except that the switch assembly 200 can include only one light emitting surface 2226. The light guiding portion 222 can include a first light incident surface 2221 forming a portion of the first surface 2210 and positioned substantially above the first LED 214, a second light incident surface 2222 forming another portion of the first surface 2210 and positioned substantially above the second LED 215, a first incident portion 2223, and a second incident portion 2224. The first incident portion 223 can extend obliquely from the first incident surface 2221 to the interior of the reflective portion 221, and the second incident portion 224 can extend obliquely from the second incident surface 2222 to the interior of the reflective portion 121. The light guiding portion 222 can further include an emitting portion 2225 at the ends of the first incident portion 2223 and the second incident portion 2224. The light guiding portion 222 can further include a light emitting surface 2226 positioned correspond to the emitting portion 2225. The emitting portion 2225 and the light emitting surface 2226 can protrude out of the reflective portion 221, and the light emitting surface 2226 can form a portion of the second surface 2220. When the first LED 214 or the second LED 215 emits light, the light can be transmitted to the light emitting surface 2226, and then the light can be transmitted to the outside of the switch element 220. As the first LED 214 and the second LED 215 can emit light of different colors, the color of light transmitted out of the switch element 220 can indicate to user which switch contact is switched on.

Figure 6:
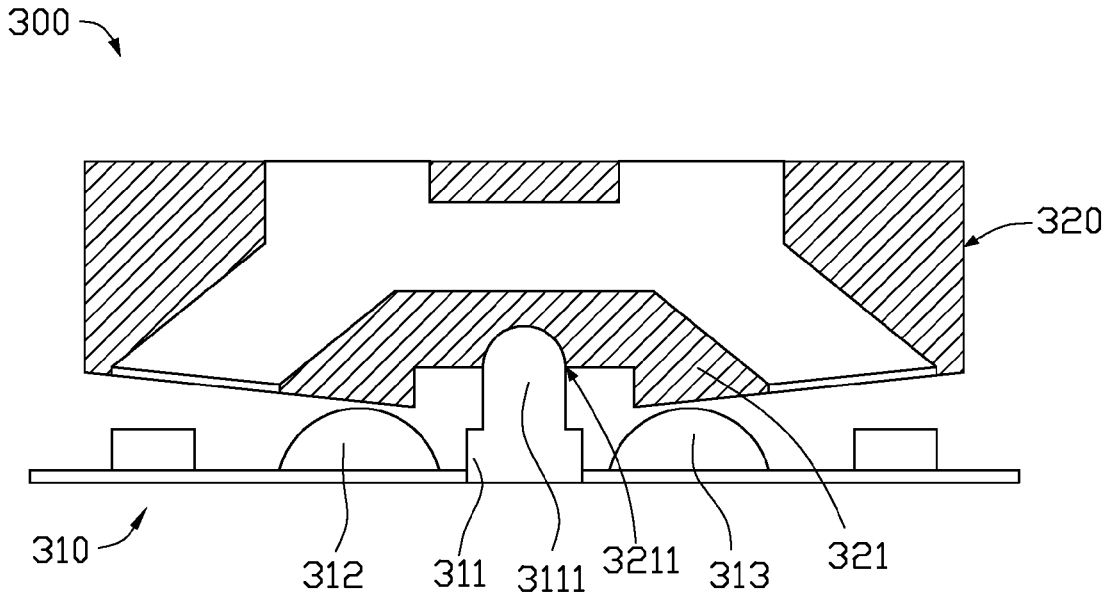
FIG. 6 is a cross-sectional view of another embodiment of a switch assembly.

FIG. 6 illustrates a switch assembly 300 according to another embodiment. The switch assembly 300 of this disclosure can include a base plate 310 and a switch element 320. The base plate 310 can include a protrusion 311 in the middle portion, a first LED 312, a second LED 313, a first switch contact 314, and a second switch contact 315. The switch assembly 30 is substantially same as the switch assembly 100, except that the protrusion 311 can include a column 3111 positioned substantially vertical to the base plate 310. The bottom of the switch element 320 can include a supporting portion 321 having a recess 3211 corresponding to the column 3111, and the column 3111 of the base plate 310 can be movably assembled in the recess 3211 of the switch element 320.

The embodiments shown and described above are only examples. Many details are often found in the art such as the other features of a switch assembly. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A switch assembly comprising;

a base plate having:

a protrusion;

a first light emitting diode positioned on a first side of the protrusion;

a second light emitting diode positioned on a second side of the protrusion opposite the first side;

a first switch contact positioned on the first side of the protrusion between the first light emitting diode and the protrusion; and a second switch contact positioned on the second side of the protrusion between the second light emitting diode and the protrusion; and a switch element movably mounted on the protrusion and contactable with the first switch contact and the second switch contact, the switch element having a first surface facing the base plate and a second surface substantially opposite the first surface and facing away from the base plate;

wherein, the switch element includes a light guiding portion with a first light incident surface forming a portion of the first surface and positioned substantially above the first light emitting diode, a second light incident surface forming another portion of the first surface and positioned substantially above the second light emitting diode and a light emitting surface forming a portion of the second surface.

2. The switch assembly of claim 1, wherein the light incident surfaces and the light emitting surface are made of transparent composite materials.

3. The switch assembly of claim 1, wherein the first switch contact and the second switch contact are made of an elastic metal reed.

4. The switch assembly of claim 1, wherein the light guiding portion further comprises a first incident portion and a second light incident portion positioned oblique to the base plate and in symmetry.

5. The switch assembly of claim 4, wherein the light guiding portion further comprises an emitting portion at the ends of the two incident portions.

6. The switch assembly of claim 1, wherein the first light emitting diode and the second light emitting diode emit light of different colors.

7. The switch assembly of claim 6, wherein the colors of the first light emitting diode and the second light emitting diode are selected from the group of blue, red, yellow, and white.

8. The switch assembly of claim 1, wherein the switch element further comprises a reflective portion, and the light guiding portion is surrounded by the reflective portion.

9. The switch assembly of claim 8, wherein the switch element comprises two light emitting surfaces separated by a part of the reflective portion.

10. The switch assembly of claim 8, wherein the reflective portion comprises a supporting portion at the bottom thereof, the two ends of the supporting portion are oblique to the base plate and contactable with the first switch contact and the second switch contact.

11. The switch assembly of claim 10, wherein the protrusion comprises a recess, the supporting portion comprises a protrusion part movably assembled in the recess of the protrusion.

12. The switch assembly of claim 10, wherein the protrusion comprises a column substantially positioned vertical to the base plate; the support portion comprises a recess, and the column of the protrusion is movably assembled in the recess of the reflective portion.

* * * * *